United States Patent [19]

Rhodes

[11] Patent Number: 4,638,740

[45] Date of Patent: Jan. 27, 1987

[54] DEVICE FOR SELECTIVELY COUPLING A MOVABLE LOAD BEARING UNIT TO A LINK CHAIN CONVEYOR FLIGHT

[76] Inventor: Arthur B. Rhodes, 3347 Camp Ground Rd., Louisville, Ky. 40211

[21] Appl. No.: 814,808

[22] Filed: Dec. 30, 1985

[51] Int. Cl.[4] ..... B61B 10/04

[52] U.S. Cl. ..... 104/172.2; 104/172.5

[58] Field of Search ..... 104/140, 141, 172 R, 104/172 BT, 172 C, 184, 185; 198/803.01

[56] References Cited

U.S. PATENT DOCUMENTS

| | | | |
|---|---|---|---|
| 1,420,115 | 6/1922 | Lange et al. | 104/172 BT |
| 2,576,178 | 11/1951 | Hiles et al. | 104/172 BT |
| 3,478,697 | 11/1969 | Bradt | 104/172 BT |
| 3,878,793 | 4/1975 | Turner | 104/172 BT |
| 4,438,702 | 3/1984 | Rhodes | 104/172 BT X |

FOREIGN PATENT DOCUMENTS

| | | | |
|---|---|---|---|
| 1222919 | 6/1960 | France | 104/172 BT |
| 1405549 | 10/1968 | Fed. Rep. of Germany | 104/172 C |
| 1455029 | 11/1968 | Fed. Rep. of Germany | 104/172 BT |

*Primary Examiner*—Robert B. Reeves
*Assistant Examiner*—David F. Hubbuch

[57] ABSTRACT

A device for selectively coupling a movable load bearing unit, such as a pallet, to a link chain conveyor flight so that the pallet will selectively be moved with the conveyor flight along a path defined by the conveyor flight. The coupling device includes a stem mounted to the pallet for longitudinal movement in a vertical direction and a flight engagement pin longitudinally aligned with and depending from the stem. The stem is sized and configured for insertion into one of the openings of the link chain. The pin is generally rectangular in transverse cross-section. In addition, the coupling device also has a generally planar plate extending generally perpendicularly from the pin in a direction upstream therefrom, relative to the direction of movement of the conveyor flight, and in a direction downstream therefrom, relative to the direction of movement of the conveyor flight. The plate is used to maintain directional stability to the pin as the pin moves into and out of engagement with the link chain conveyor flight. The depending end of the pin is formed with a ramp surface sloping downwardly in the direction of movement of the conveyor flight. The ramp surface provides a lead in angle for the pin as it is lowered to be inserted into one of the openings of the chain links of the conveyor flight as well as a clearance for the conveyor flight passing beneath the depending end of the pin when the pin is raised to be removed from one of the openings of the chain links of the conveyor flight.

11 Claims, 7 Drawing Figures

DEVICE FOR SELECTIVELY COUPLING A MOVABLE LOAD BEARING UNIT TO A LINK CHAIN CONVEYOR FLIGHT

BACKGROUND OF THE INVENTION

1. Field of the Invention

The invention relates to devices for selectively coupling a first item to a moving second item for movement therewith. More particularly, the invention relates to a coupling device for selectively coupling and uncoupling a load bearing unit to a moving flight of a link chain conveyor.

2. Discussion of the Prior Art

Examples of various coupling devices for selectively coupling a load bearing unit, such as a pallet and the like, to a conveyor shown in:

U.S. Pat. No. 2,918,020
U.S. Pat. No. 3,032,173
U.S. Pat. No. 3,045,610
U.S. Pat. No. 3,048,126
U.S. Pat. No. 3,194,177
U.S. Pat. No. 3,196,807
U.S. Pat. No. 3,390,641
U.S. Pat. No. 3,467,025
U.S. Pat. No. 3,618,532
U.S. Pat. No. 3,648,618
U.S. Pat. No. 3,874,302.

The various coupling devices proposed by the above-listed U.S. Pats. are relatively complicated, which makes them expensive to make and maintain in operation.

U.S. Pat. No. 4,438,702, issued to Arthur B. Rhodes on Mar. 27, 1984, teaches a simple, straightforward coupler device which has some features in common with the coupler device of the present invention. The coupler device of this patent includes a conveyor chain engaging pin attached to a load bearing unit for longitudinal movement between a lowered, conveyor chain engaging position whereat the depending end of the pin engages the links of the conveyor chain, and a raised, conveyor chain disengaged position whereat the free depending end of the pin is removed from engagement with the links of the conveyor chain.

While this coupler device works extremely well, it has been observed that in some situations after long use, that apparently due to wear of the pin or the conveyor chain, or a stack-up of manufacturing tolerance between the pin and conveyor chain, the pin can slip off-center relative to the longitudinal axis of the chain. This off-center condition of the pin when inserted in a chain link can cause lateral forces or movement forces to be applied to the pin sufficient to interfere with the movement of the pin between the lower engaged position and raised disengaged position. Further, it has also been experienced that from time to time in some installations that when the pin is in the raised disengaging position, the conveyor chain may make brushing contact with the depending pin end. This condition can generate noise as well as wear of the pin and conveyor chain.

SUMMARY OF THE INVENTION

The present invention recognizes these potential conditions and provides a straightforward solution.

More particulary, the present invention provides a device for selectively coupling and uncoupling a movable load bearing unit to a link chain conveyor flight comprising a stem portion attached to the load bearing unit, the stem portion being movable between a raised chain conveyor flight disengaged position and a lowered chain conveyor flight engaged position; pin means for insertion into the opening of the link chain, the pin means being associated with the stem portion for movement therewith, and the stem means being generally rectangular in transverse cross-section; a generally planar plate extending perpendicularly from the pin means in a direction toward the front of the pin means relative to the direction of movement of the conveyor flight and in a direction toward the rear of the pin means relative to the direction of movement of the conveyor flight, the bottom surface of the planar plate being adapted to contact the chain links of the conveyor flight to the front side and rear side of the opening in the chain link in which the pin means is inserted when the stem means is in the lowered engaged position; and a ramp surface formed in the depending end of the pin means for guiding the pin means into the opening of a chain link of the link chain flight as the pin means moves downwardly into the engaged position.

BRIEF DESCRIPTION OF THE DRAWINGS

A better understanding of the invention will be had upon reference to the following discussion on conjunction with the drawings in which like numerals refer to like parts throughout and wherein.

DETAILED DESCRIPTION OF THE PREFERRED EMBODIMENT

Figure 1:
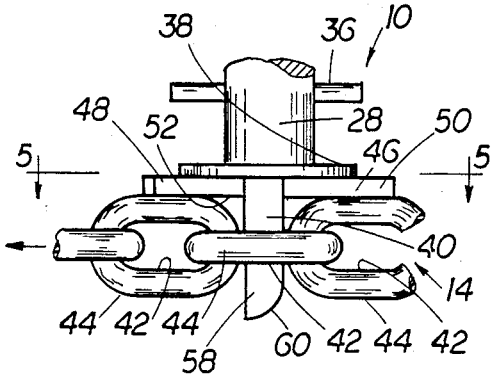
FIG. 1 is a side view of the coupler device of the present invention in the lowered chain flight conveyor engaged position.

With reference to FIGS. 1 through 4, there is shown a coupler device, generally denoted as the numeral 10, for selectively coupling and uncoupling a load bearing unit 12 (see FIG. 7) to a moving flight 14 of a chain link conveyor system.

Chain link conveyor systems are well known and used for moving load bearing units, such as carts or pallets, along a path defined by a flight of the conveyor. Such conveyor systems have particular application in, for example, manufacturing for moving workpieces through various work stations. Such conveyor systems generally include an endless conveyor chain having a generally horizontal run or top flight 14 which moves along a floor of a facility defining the path along which the carts or pallets 12 will move. For the reasons that such chain conveyor systems are well known, and do not comprise a part of the present invention, for the sake of brevity and clarity of understanding the present invention, a chain conveyor system will not be further discussed.

It is advantageous that the flow of carts or pallets 12 moving with the moving link chain conveyor flight 14 be selectively interrupted at various work stations along the defined path to, for example, allow sufficient time for an operation to be performed on the item being conveyed on the cart or pallet 12. Toward this end, coupler activating means, generally denoted as the numeral 16, are provided for raising and lowering the coupler device 10 between the coupling and uncoupling positions. The coupler activating means 16 is shown as including an elongated cam plate located to one side of and generally parallel to the moving flight 14 of the chain link conveyor system. The elongated cam plate comprises an upwardly sloping advance section 18, a generally horizontal elongated dwell section 20, and a downwardly sloping return section 22. As shown, the upwardly sloping advance section 18 begins to slope downwardly from the level of the horizontal moving conveying chain flight 14. The downwardly sloping cam return section 22 begins to slope downwardly from the terminal end of the dwell section 20 to its bottom end at about the level of the horizontal moving conveying chain flight 14.

Figure 7:
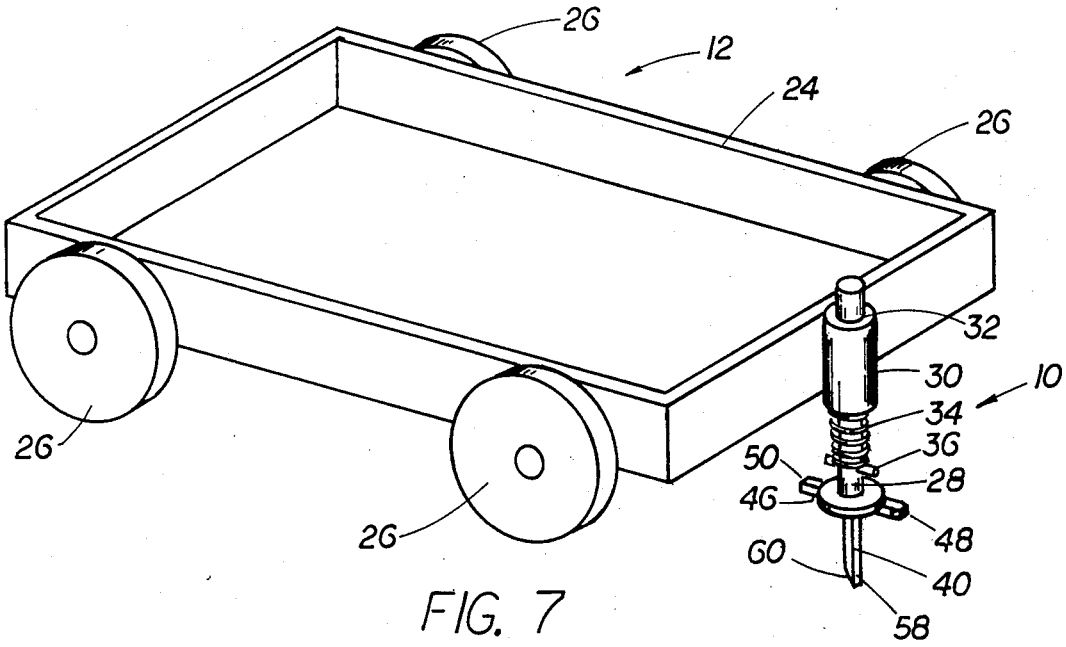

With reference to FIG. 7, as shown, each of the carts or pallets 12 to be moved along the path defined by the horizontal flight 14 of the link chain conveyor includes a frame structure 24, and floor engagement wheels 26 rotatably attached to the frame structure 24. The frame structure can be or virtually any construction and configuration to support the load carried thereon.

Figure 3:
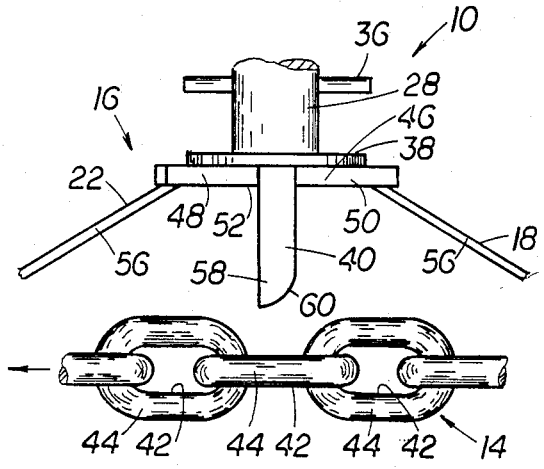
FIG. 3 is a side view of the coupler device of the present invention in the raised chain flight disengaged position.
Figure 2:
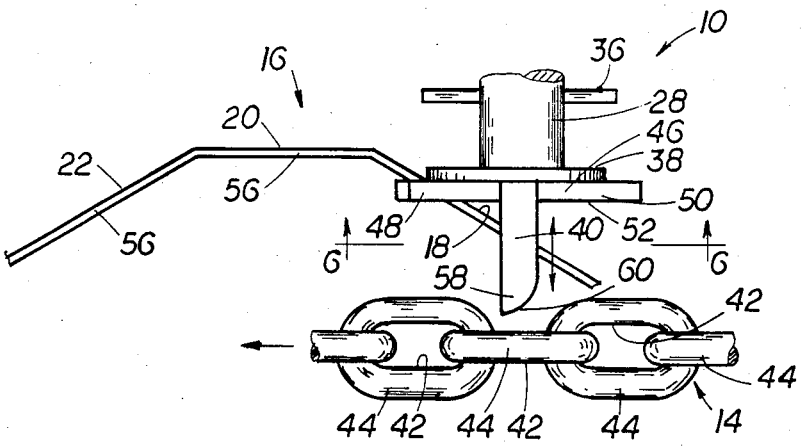
FIG. 2 is a side view of the coupler device of the present invention in the process of moving upwardly from the chain flight conveyor engaged position to the raised chain flight conveyor disengaged position.
Figure 4:
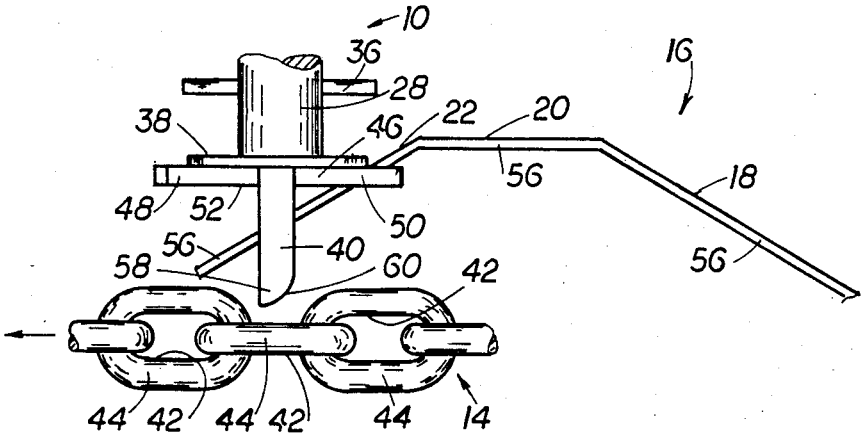
FIG. 4 is a side view of the coupler device of the present invention in the process of moving downwardly from the chain flight conveyor disengaged position to the chain flight conveyor engaged position.

With reference to FIG. 7, the coupler device 10 is attached to the cart frame 26 for vertical movement between a lowered conveyor chain flight coupled or engaged position (see FIG. 1) and a raised conveyor chain flight uncoupled or disengaged position (see FIG. 3).

With continued reference to FIG. 7 and additional reference to FIGS. 1 through 6, the coupler device 10 comprises a generally cylindrical stem portion 28 axially, slidably received in a cylindrical collar 30. The collar 30 is attached to the cart frame 24 with the longitudinal axis of its bore 32 vertically oriented. The movable stem portion 28 is received in the collar bore 32 with the top end of the stem portion 28 protruding upwardly out of the top end of the collar bore 32 and with the bottom end of the stem portion protruding downwardly out of the bottom end of the collar bore 32. The movable stem portion 28 is biased toward the lowered conveyor chain flight engaging position by means of, for example, a coil spring 34. By way of example, the coil spring 34 is concentrically located over the end of the stem portion 28 protruding from the botttom end of the collar 30.

The coil spring 34 is placed under compression between a spring keeper 36 attached to the stem portion 28 spaced from the bottom end of the collar 30 a sufficient distance to accommodate the spring 34. A cam follower plate 38 is attached to the bottom protruding end of the stem portion 28. The cam follower plate 38 is shown as being a disc coaxial with the stem portion 28. The cam follower plate 38 is adapted to sequentially contact the advance can section 18, dwell section 20 and return cam section 22 of the coupler activating means to cause the coupler device 10 to disengage from and engage with the conveyor chain flight 14 as the carts 12 move along the conveyor path. Further, a pin, generally denoted as the numeral 40, for insertion into the openings 42 of the chain links 44 of the moving chain conveyor flight 14 is associated with the stem portion 28 for movement therewith between the lowered chain conveyor flight engaged position and raised chain conveyor flight disengaged position. The pin 40 is shown as being coaxial with the stem portion 28 and attached to the bottom protruding end of the stem portion 28. The cam follower plate 38 is shown as being located proximate the junction of the stem portion 28 and conveyor flight engaging pin 40. As can be best seen in FIGS. 5 and 6, the pin 40 is generally rectangular in transverse cross-section, and is sized to fit into the openings 42 of the chain links 44 of the conveyor flight 14. In addition, a generally planar plate 46 associated with the pin 40 has a front end 48 which extends perpendicularly from the pin 40 in a forward or downstream direction from the front of the pin 40, relative to the movement of the moving conveyor chain flight 14 and also a rear end 50 which extends in a rearward or upstream direction from the back of the pin 40, relative to the movement of the moving conveyor chain flight 14. The bottom surface 52 of the plate 46 is adapted to contact the chain links 44 to the front and rear sides of the opening 42 of the chain link 44 in which the pin 40 is inserted when the coupler device 10 is in the lower chain conveyor flight engaged position. In addition, at least one of the longitudinal side edges 54 of the planar plate 46 is adapted to contact and move along the longitudinal edge 56 of the elongated cam plate 16 adjacent to the chain conveyor moving flight 14. As can best be seen in FIGS. 1 through 4, the depending end 58 of the pin 40 has a beveled surface 60 for guiding the pin 40 smoothly into an opening 42 of one of the chain links 44 of the moving chain conveyor flight 14 as the pin 40 moves downwardly into the conveyor flight engaged position. Preferably, the beveled surface 60 is formed to face generally rearwardly or in the upstream direction relative to the movement of the moving conveyor chain flight 14.

Beginning with FIG. 1, in operation with the pin 40 in the lowered conveyor chain flight engaged position such that the pin 40 is inserted in an opening 42 of a chain link 44 of the conveyor chain flight 14, the cart or pallet 12 will move with the moving chain conveyor flight 14. When the cart or pallet 12 reaches the elongated cam plate 16 at predetermined location along the conveying path, the cam follower plate 38 of the coupler device 10 contacts the advance cam section 18 and the longitudinal side edge 54 of front extending end 48 of the planar plate 46 of the coupler device 10 slidable contacts the longitudinal side edge 56 of the advance cam section 18 of the elongated cam plate 16. As the cart or pallet 12 continues to move with the moving conveyor flight 14 the advance cam section 18 forces the pin 40 and stem 28 of the coupler device 10 upwardly against the biasing force of the coil spring 34 until the cart of pallet 12 has advanced along the conveyor path sufficient to move the cam follower plate 36 of the coupler device 10 onto the dwell cam section 20 of the elongated cam plate 16 at which point the depending end 58 of the pin 40 has been pulled completely from the opening 42 of the chain link 44 in which it was inserted. As the pallet 12 is moved along the elongated cam plate 16, the cam follower plate 38 of the coupler device 10 contacts and moves along the dwell cam section 20 such that the pin 40 is held in the upward disengaged position and the longitudinal side edge 54 of the entire planar plate 46 slidably contracts the longitudinal side edge 56 of the dwell cam section 20 of the cam plate 6 until it reaches the return cam section 22. Upon reaching the return cam section 22, the cam follower plate 38, dut to the biasing force of the coil spring 34, follows the downwardly sloping return cam section 22 of the cam plate 16, and the longitudinal side edge 54 of the rearwardly extending end 50 of the planar plate 46 slidably contacts the longitudinal side edge 56 of the return cam section 22 of the cam plate 16. Thus, the pin 40 is gradually lowered back to the lowered conveyor chain engaging position whereupon the pin 40 reengages an opening 42 of a chain link 44 of the conveyor flight 14. As the pin 40 is lowered, the beveled surface 60 at the depending pin end 58 may contact the link 44 trailing the link opening 42 in which the pin 40 is inserted. This beveled end, thus, guides the pin 40 into the link opening 42. The contact between the longitudinal side edge 54 of the planar plate 46 and the longitudinal side edge 56 of the elongated cam plate 16 prevents the pin 40 from rotating about the longitudinal axis of the stem 28 in the bore 32 of the bearing collar 30.

Figure 5:
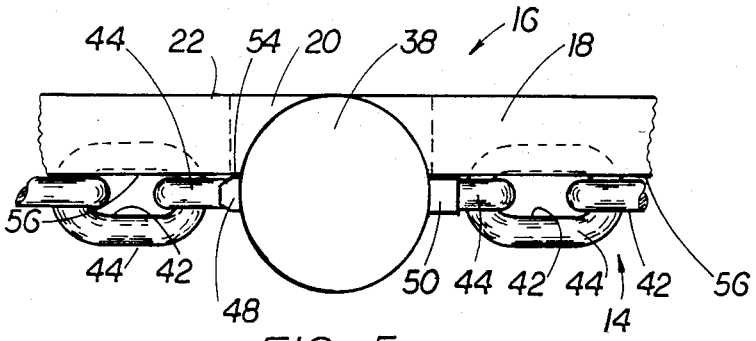
FIG. 5 is a top view of the coupler device as seen in the direction of arrows 5—5 in FIG. 1.
Figure 6:
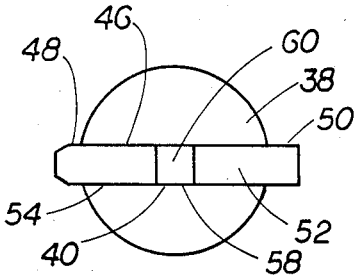
FIG. 6 is a bottom view of the coupler device as seen in the direction of arrows 6—6 in FIG. 2; and, FIG. 7 is a perspective view of a load bearing unit having the coupler device of the present invention.

As can be seen best in FIG. 5, typically the openings 42 in the chain links 44 are oblong. The rectangular configuration of the transverse cross-sectional shape of the pin 40 keeps the pin 40 centered on the longitudinal axis of the oblong link opening 42, thus, obviating the possibility of the pin 40 exerting an off-center force on the link 44 defining the opening 42 as can occur with cylindrical pins.

The following detailed description is given primarily for clearness of understanding and no unnecessary limitations are to be understood therefrom for modifications will become obvious to those skilled in the art upon reading this disclosure and may be made without departing from the spirit of the invention and scope of the appended claims.

What is claimed is:

1. A device for selectively coupling and uncoupling a movable load bearing unit to a moving link chain conveyor flight comprising:

stem means attached to the load bearing unit, the stem means being movable between a raised chain conveyor flight disengaged position and a lowered chain conveyor flight engaged position;

pin means for insertion into the opening of the link chain conveyor flight, the pin means being associated with the stem means for movement therewith, and the pin means being generally rectangular in transverse cross-section;

a planar plate extending perpendicular from the pin means in a forward direction from the front side of the pin means and in a rearward direction from the rear side of the pin means, the bottom surface of the planar plate being adapted to contact the chain links of the chain link conveyor flight to the upstream and downstream sides of the opening in the chain link in which the pin means is inserted when the stem means is in the lowered engaged position; and, a beveled surface formed in the depending end of the pin means for guiding the pin means into the opening of the chain link as the pin means moves downwardly into the conveyor flight engaged position.

2. The device of claim 1, wherein the beveled surface at the depending end of the pin means faces generally in an upstream direction relative to the direction of movement of the link chain conveyor flight.

3. The device of claim 1, wherein the stem means and pin means are resiliently biased toward the lowered chain conveyor flight engaged position.

4. The device of claim 1, further comprising:

a bearing collar attached to the load bearing unit oriented with the longitudinal axis of the bearing collar being generally vertical; and, the stem means being coaxially received within the bearing collar for movement along the longitudinal axis of the collar bore.

5. The device of claim 1, further comprising cam follower means associated with the stem means.

6. The device of claim 5, wherein the cam follower means comprises a cam follower plate projecting generally perpendicular to the longitudinal axis of the pin means.

7. The device of claim 1, further comprising coupler activating means located next to the link chain conveyor flight for causing the pin means to move between the engaged and disengaged positions as the load bearing unit moves past the coupler activating means.

8. The device of claim 7, further comprising cam follower means associated with the stem means and adapted to coact with the coupler activating means to cause the pin means to move between the engaged and disengaged positions.

9. The device of claim 8, wherein:

the coupler activating means comprises a cam plate; and, the cam follower means comprises a cam follower plate projecting perpendicularly to the longitudinal axis of the pin means adapted to contact the cam plate.

10. The device of claim 7, wherein the planar plate extending from the pin means is adapted to coact with the coupler activating means to prevent the pin means from rotating about the longitudinal axis of the stem means as the pin means is being moved between the engaged and disengaged positions.

11. The device of claim 10, wherein the coupler activating means comprises a cam plate, and one longitudinal edge of the planar plate extending from the pin means is adapted to contact one longitudinal side of the cam plate as the pin means moves between the engaged and disengaged positions.

* * * * *